United States Patent [19]

Brock

[11] Patent Number: 4,753,407

[45] Date of Patent: Jun. 28, 1988

[54] RISER ASSEMBLY FOR HAIRDRESSING CHAIR

[76] Inventor: Robert L. Brock, 1815 Crandon Dr., Charlotte, N.C. 28216

[21] Appl. No.: 42,636

[22] Filed: Apr. 24, 1987

[51] Int. Cl.[4] ..... A47C 7/50

[52] U.S. Cl. ..... 248/346; 248/163.1; 297/423

[58] Field of Search ..... 248/673, 678, 679, 146, 248/152, 176, 200, 213.2, 300, 127, 163.1, 346, 188.2; 297/423, 429

[56] References Cited

U.S. PATENT DOCUMENTS

| | | | |
|---|---|---|---|
| 801,398 | 10/1905 | Ray | 297/429 |
| 1,319,774 | 10/1919 | Kallajian | 248/346 |
| 1,603,954 | 10/1926 | Huston | 248/346 |
| 2,553,545 | 5/1951 | Booth | 297/240 |
| 2,683,579 | 7/1954 | Wallace | 248/146 |
| 2,712,917 | 7/1955 | Flora | 248/300 |
| 3,099,244 | 7/1963 | Knapp | 248/346 |
| 4,549,767 | 10/1985 | Hampshire | 297/439 |
| 4,550,894 | 11/1985 | Barlics | 248/346 |

FOREIGN PATENT DOCUMENTS

| | | | |
|---|---|---|---|
| 2222970 | 11/1973 | Fed. Rep. of Germany | 248/346 |
| 2421062 | 11/1974 | Fed. Rep. of Germany | 297/429 |
| 356119 | 2/1929 | United Kingdom | 248/163.1 |

*Primary Examiner*—J. Franklin Foss
*Assistant Examiner*—Robert A. Olson
*Attorney, Agent, or Firm*—Steven J. Hultquist

[57] ABSTRACT

A riser assembly for a chair with a base normally reposed on a floor surface, comprising a base having a series of circumferentially spaced-apart retention openings in a peripheral portion thereof, and a foot rest associated therewith. The foot rest has legs of a size to be insertable into the openings in the riser base peripheral portion, to position the foot rest on the riser base, and a bearing member joined to the platform and engaging a chair base as positioned on the riser base, to support the platform in an upwardly inclined position. The riser assembly has utility as a support structure for hairdressing and similar chairs, permitting a standing person servicing an individual seated in the chair to assume standing positions which reduce or eliminate stress and fatigue.

7 Claims, 1 Drawing Sheet

RISER ASSEMBLY FOR HAIRDRESSING CHAIR

BACKGROUND OF THE INVENTION

1. Field of the Invention

This invention relates to a riser assembly which provides increased elevation for a chair having a base normally positioned on a floor surface, and permits a standing individual serving a person in the chair to reduce the stress and fatigue associated with standing for prolonged periods of time.

The invention thus is particularly suited for use with chairs for barbering, dermatological, optometric, and similar services.

2. Description of the Related Art

In the provision of barbering, manicuring, dermatological, optometric, and similar services, the service typically is rendered by a standing person to a seated subject. In these businesses, it is common practice for the individual service provider to stand for the major portion, if not all, of a working day, and such individuals thus experience considerable physiological stress and fatigue, particularly in the back region and lower extremities.

In many instances, the aforementioned difficulties are exacerated when the standing person is of above average height, even with the provision of elevator means in barber and similar chairs which enable the seated person to be raised or lowered to a selected height. The tall barber or hairdresser thus is compelled to slump and assume a posture suitable for access to the seated subject, which frequently results in serious distress to the spinal area and back muscles, particularly in the lumbar region.

Relative to the footrest feature of the invention, the relevant art includes the adjustable foot support disclosed in U.S. Pat. No. 4,549,767 to J. F. Hampshire, et al. The foot support of this patent has a unitary construction, and includes a platform on which the user's feet are positionable, with a base supporting the platform. The base features an upwardly extending bracket assembly with a plurality of stepped channels, which selectively cooperate with a downwardly extending leg from the platform, so that the platform is selectively positionable in an inclined position with respect to the base.

Accordingly, it is an object of the present invention to provide a riser assembly, for a chair of a type normally reposed on a floor surface on a chair base, which facilitates the necessary elevation of the sitting subject when the height provided by the conventional chair, either with or without elevator features, presents an inadequate height to the standing person serving the seated individual.

It is another object of the invention to provide a riser assembly of the aforementioned type, which may be provided with a footrest structure permitting the weight of the standing person to be shifted to reduce spinal distress and fatigue of the back and legs caused by prolonged standing.

It is a still further object of the invention to provide a riser assembly as described above, which is easily fabricated and readily applied to existing hairdressing and barber chairs, and the like.

Other objects and advantages of the present invention will be more fully apparent from the ensuing disclosure and appended claims.

SUMMARY OF THE INVENTION

The one aspect, the present invention relates to a riser assembly for a chair with a base normally reposed on a floor surface, the riser assembly comprising a riser base having a top surface on which the chair base is positioned, and an upstanding ridge member extending circumferentially around a peripheral portion of the riser base on the top surface thereof, for laterally retaining the chair base on the riser base Another aspect of the invention relates to a riser assembly for a chair with a base normally reposed on a floor surface, comprising:

(a) a riser base having a top surface on which the chair base is positioned;

(b) a series of circumferentially spaced-apart retention openings in a peripheral portion of the riser base; and (c) a footrest, comprising:

(i) a supporting platform;

(ii) legs joined to a first end of the platform, said legs being of a size to be insertable into the openings in the riser base peripheral portion, to position the footrest on the riser base; and (iii) a bearing member, joined to the platform and engageable with the chair base as positioned on the riser base, to support the platform in an upwardly inclined position.

A still further aspect of the invention relates to a riser assembly comprising both the aforementioned upstanding ridge member retaining structure, and footrest.

Other features and embodiments of the invention will be more fully apparent from the disclosure.

DETAILED DESCRIPTION OF THE INVENTION, AND PREFERRED EMBODIMENTS THEREOF

The riser assembly of the present invention may be usefully employed with chairs of the type having a base normally reposed on a floor surface. Illustrative of chairs of such type are those employed in beauty salons, barber shops, optometrists' offices, and the like.

A common chair design of such type features a seat and back unit, optionally with side arms, mounted on a central pedestal whose lower end is fixed to a base having a flat bottom surface contacting the floor and a convex top surface having a maximum height in the vicinity of the aforementioned pedestal and continuously tapered through a thinner peripheral edge portion.

The riser assembly of the invention permits the affective height of such chairs, relative to a standing person servicing an individual seated in the chair, to be increased to a selected extent, whereby stooping and other working postures promoting fatigue and backache, circulatory problems, etc., are reduced or substantially eliminated.

In one embodiment, the riser assembly features a footrest which is particularily advantageous to enable the standing service provider to shift his weight while standing to an alternative supporting position, whereby the movement between a fully standing position and a footrest-supported standing position additionally reduces fatigue and permits a postural position to be adopted which is beneficial in terms of resisting fatigue during work in such standing position.

Figure 1:
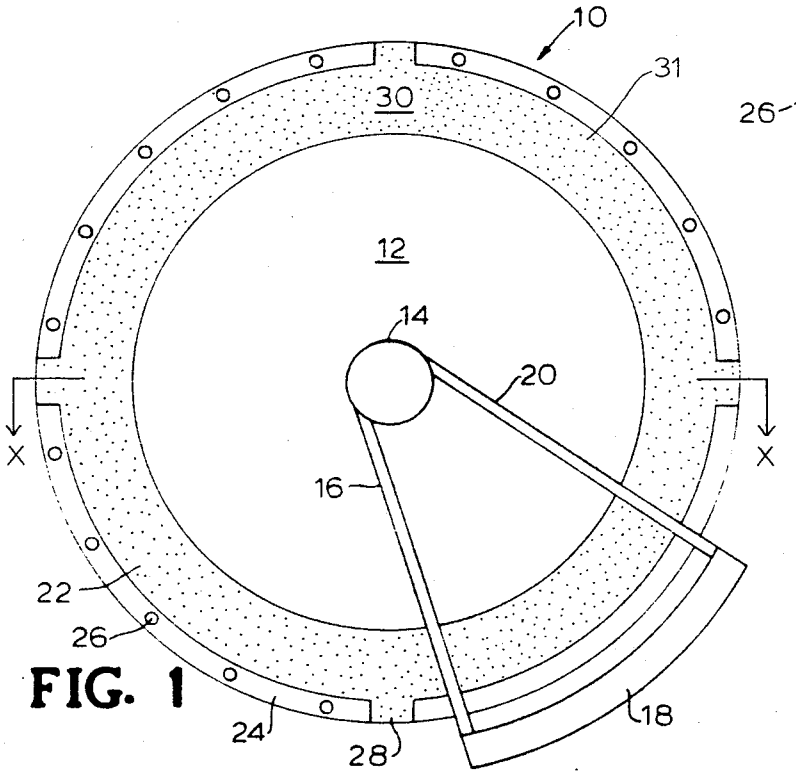
FIG. 1 is a top plan view of a chair riser assembly according to one embodiment of the invention.
Figure 2:
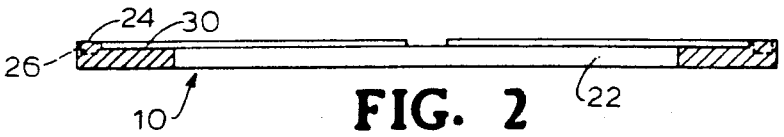
FIG. 2 is a sectional elevation view of the riser assembly of FIG. 1, taken along line X—X of FIG. 1.

Referring now to the drawings, wherein the same numbers refer to the same device elements, FIG. 1 shows a plan view of the riser assembly 10, comprising the riser base 22 having a top surface 30 on which the chair base 12 is positioned. The details of the chair are more clearly shown in FIG. 3, which is a partial section, elevational view of a lower portion of a chair supported on the riser assembly 10, reposing on the top surface 30 of the riser base 22. The riser base may have a central open portion as in the embodiment shown, or it may be diametrically continuous across its full extent, it being necessary only that the riser base provides the requisite supporting and retaining structure for the chair base to be reposed thereon.

As shown, the supported chair comprises a base 12 which in side elevation is convexly curved. At the center of the base 12 is mounted a central pedestal 14 which, as indicated, supports the seat and back assembly with the chair at the upper end of the pedestal.

Mounted on the pedestal is a pump actuator comprising a foot pedal 18 connected by radial arms 16 and 18 to the pedestal, and coupled in a known manner to suitable pneumatic or hydraulic means which raise or lower the chair in response to the pumping action carried out by successively depressing the foot pedal 18. Although such foot pedal is operative to raise or lower the chair, the extent of such elevation differential, between the highest and lowest positions, is generally rather limited. The riser assembly of the invention thus serves a particularly advantageous function in providing the chair with a height suitable to achieve elevations which are suited to a standing person of greater than average height.

On the top surface 30 of the riser base 22 is provided an upstanding ridge member 24 circumferentially extending around a peripheral portion of the riser base on such top surface for laterally retaining the chair base 12 on the riser base 22. By "laterally retaining" is meant that the chair base is prevented from moving sideways off the top surface of the riser base.

In the embodiment shown (see FIG. 1), the circumferentially extending ridge member 24 is discontinuous at 90 degree intervals around the circumference at the periphery of the riser base. By such "notched" configuration, spaced-apart openings are provided in the ridge, by means of which the riser base, when used as a support means for a barber or haircutting chair, facilitates sweeping out hair from the top surface of the riser base and the top surface of the chair base reposed thereon.

It will be recognized that the riser assembly of the invention is broadly applicable to many chair types, other than those used in barbering or tonsorial applications, and in such other usages the ridge member may be provided as a continuous element around the periphery of the riser base.

Figure 3:
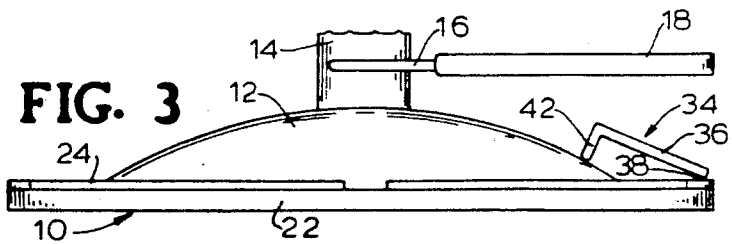
FIG. 3 is an elevation view of a riser assembly according to another embodiment of the invention, showing the base of a chair reposed thereon.
Figure 4:
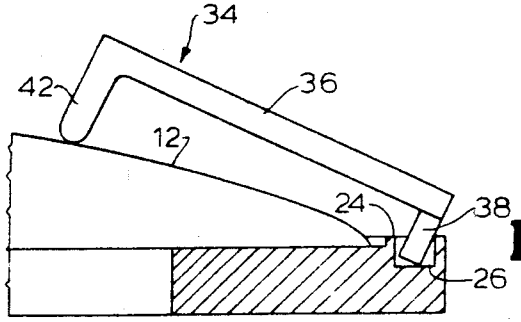
FIG. 4 is a sectional elevation view of a portion of the riser assembly of FIG. 3, showing the details of construction of the footrest and retaining structure.
Figure 5:
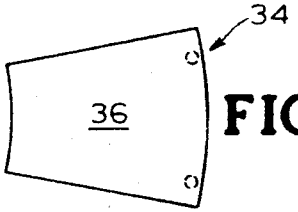
FIG. 5 is a top plan view of the footrest of the FIGS. 3 and 4 embodiment.

In the riser assembly embodiment shown in FIGS. 1–4, the circumferentially extending peripheral ridge member 24 has a series of circumferentially spaced-apart retention openings 26 therein to accommodate the foot rest 34, as best shown in FIGS. 3 and 4. The construction of the foot rest per se is further shown in FIGS. 5–7, in respective top plan, frontal elevation, and side elevation views.

Figure 6:
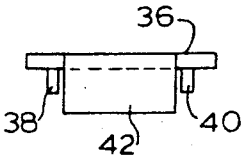
FIG. 6 is a front elevation view of the footrest of FIG. 5.
Figure 7:
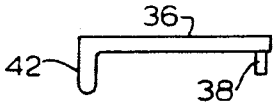
FIG. 7 is a side elevation view of the footrest of FIGS. 5 and 6.

The foot rest 34 comprises a support platform 36 having legs 38 and 40 joined to a first end thereof (FIG. 6). These legs are of a size to be insertable into the openings 26 in the peripheral portion of the riser base, in the ridge member 24. In such manner, the foot rest is positioned on the riser base.

A bearing member 42 is joined to the platform and engages the chair base as positioned on the riser base, so that the platform is supported by the riser base and chair base, in an upwardly inclined position. The bearing member 42, as shown, may be integrally formed with the platform by molding, machining, casting, bending etc., depending on the material of construction.

In like manner, the legs 38 and 40 may be integrally formed with the platform, whereby the footrest is provided as a unitary construction element of the riser assembly. Alternatively, the bearing member 42 and legs 38 and 40 may be provided as separate elements which are bonded, welded, mechanically fastened, or otherwise joined to the platform 36 to form the footrest structure.

In the construction shown, the respective legs 38 and 40 are reposed in adjacent openings 26 in the periphery of the riser base, at the portion thereof where the ridge member 24 is disposed. As can be seen from the plan view of FIG. 1, the footrest may be circumferentially moved about the periphery of the chair base, to accommodate the position of the standing individual servicing the person in the chair reposed on such riser assembly, by the simple expedient of removing the legs 38 and 40 from one pair of adjacent holes and repositioning them at some other, circumferentially displaced position, in another pair of adjacent openings 26.

Alternatively, a plurality of footrest elements may be provided, and deployed at various positions around the circumference of the riser base peripheral portion, to accommodate the movement of the standee, without the necessity of moving an individual footrest.

It will be noted from FIG. 1 that the lower right-hand quadrant of the ridge member does not contain any openings for accommodation of the footrest, due to the presence of the pump elevator associated with such section of the chair and riser base. In other words, the position of the pump elevator, requiring up and down movement, would interfere with a footrest positioned on such part of the riser base. It will be appreciated that in chair constructions lacking such pump elevator or similar apparatus, wherein all quadrants of the riser base peripheral portion are freely available, a series of circumferentially spaced-apart openings may be provided around the entire perimeter of the base.

In instances where lateral retention of the chair is suitably accomplished without the provision of a ridge structure of the type shown in FIGS. 1–4, the riser base may be provided with suitable circumferentially spaced apart openings for the footrest, on the flat top surface of the riser base, at its perimeter.

The riser base according to the present invention, and the footrest useable therewith, may be formed of any suitable material of construction, such as wood, metal, plastics, and the like, having suitable structural integrity, durability, good appearance, etc., for the desired use environment.

Although the riser assembly according to the invention may be provided with any suitable dimensions accommodating the chair to be reposed thereon, it may be suitable for many barber chair applications to utilize a base having a thickness on the order of from about one to about six inches, with a diameter which may be on the order of about 20 to about 36 inches, or greater, depending on the corresponding diameter of the chair base to be reposed thereon. The notch provided between the adjacent sectors of the circumferentially extending ridge may be on the order of from about 0.75 to about five inches, as measured between adjacent ridge section ends. The ridge itself may have a width, measured in a radial direction of from about $\frac{3}{4}$ to about 1.5 inches, with the openings footrest leg-receiving in the periphery of the base being on the order of about $\frac{1}{2}$ inch in diameter. The ridge itself may be on the order of about $\frac{1}{8}$–1 inch in height, and the footrest leg-receiving openings in the base may be approximately $\frac{3}{8}$ inches in depth.

For riser assemblies having the aforementioned dimensions, the footrest, of the general type shown in FIGS. 3–7, may have a length, measured from its rear end, featuring the legs 38 and 40, to the front end, featuring the downwardly extending support 42, of from about 4 to about 10 inches. The legs may each be of cylindrical shape, having a diameter of $\frac{1}{4}$ inch, and a height of 11/16 inches. The platform itself may be $\frac{3}{8}$ inch thick, and provided with a support (bearing member 42) also of $\frac{3}{8}$ inch thickness and 1.5 inches in height. A suitable length of the platform for the aforementioned dimensions may be 5 inches, accommodating both large and small feet.

As an alternative to the use of the circumferentially extending ridge member previously described, or as an adjunct thereto, the top surface 30 of the riser base 22 may be provided with a coating of a suitable slip-resistant material 31, or anti-skid appliques, or the like, to resist lateral movement of the chair base on the top surface of the riser base. Similarly, adhesive non-skid strips or like means may be applied to the bottom surface of the riser base, to resist lateral movement of the riser base on the floor surface on which it resides. Illustrative means for such purpose comprise 2 inch wide×4 inch long×$\frac{1}{4}$ inch thick non-skid strips affixed to the riser bottom surface, radially extending thereon in a lengthwise direction of the strips, and with successive strips circumferentially spaced apart from one another, e.g., at arc lengths of 60°.

In like fashion, the platform may be provided on its top surface with a slip-resistant coating, or the top surface may be abraded or otherwise mechanically roughened to provide a slip-resistant surface for retention of the foot of the standing individual servicing a person seated in the associated chair.

Although preferred embodiments of the invention have been shown and described, it will be appreciated that other variations, modifications, and embodiments of the invention are possible, and all such variations, modifications, and embodiments are to be considered within the spirit and the scope of the present invention.

What is claimed is:

1. A riser assembly for a chair with a base normally reposed on a floor surface, comprising:

(a) a riser base having a top surface for supporting a said chair base thereon;

(b) a series of circumferentially spaced-apart retention openings in a peripheral portion of said riser base; and (c) a foot rest, comprising:

(i) a supporting platform;

(ii) legs joined to a first end of said platform, said legs being of a size to be insertable into said openings in said riser base peripheral portion, to position said foot rest on said riser base; and (iii) a bearing member, joined to said platform and engageable with a said chair base as positioned on said riser base, to support said platform in an upwardly inclined position.

2. A riser assembly according to claim 1, comprising an upstanding ridge member extending circumferentially around a peripheral portion of said riser base on said top surface thereof, for laterally retaining a said chair base on said riser base.

3. A riser assembly according to claim 2, wherein said retention openings are in said ridge member.

4. A riser assembly according to claim 1, in which said bearing member is integrally formed with said platform, and comprises a flanged portion depending downwardly from a second end of said platform.

5. A riser assembly according to claim 1, wherein said platform has a length of from about 4 to about 10 inches.

6. A riser assembly according to claim 1, wherein said platform is provided with a slip-respsistant top surface.

7. A riser assembly with a chair with a base normally reposed on a floor surface, said riser assembly comprising:

(a) a riser base having a top surface on which said chair base is positionable;

(b) an upstanding ridge member extending circumferentially around a peripheral portion of said riser base on said top surface thereof, for laterally retaining said chair base on said riser base;

(c) a series of circumferentially spaced-apart retention openings in said ridge member; and (d) a foot rest, comprising:

(i) a supporting platofrm;

(ii) legs joined to a first end of said platform, said legs being of a size to be insertable into said openings in said ridge member, to position said foot rest on said riser base; and (iii) a bearing member, joined to said platform and engagable with said chair base as positioned on said riser base, to support said platform in an upwardly inclined position thereon.

* * * * *